United States Patent [19]

Ladner

[11] 4,410,084

[45] Oct. 18, 1983

[54] WATER SKI ROPE STORAGE COMPARTMENT

[76] Inventor: Charles R. Ladner, 1032 Gladstone, Azle, Tex. 76020

[21] Appl. No.: 360,464

[22] Filed: Mar. 22, 1982

[51] Int. Cl.[3] ..... B65D 85/04; B65H 75/00; B65H 75/38; B65H 75/40

[52] U.S. Cl. ..... 206/53; 242/85.1; 242/96; 206/408; 206/409

[58] Field of Search ..... 206/53, 389, 397, 398, 206/408, 409, 414, 415; 242/85, 85.1, 86.5 R, 86.5 A, 84.2 J, 96; 220/94 R, 94 A

[56] References Cited

U.S. PATENT DOCUMENTS

| | | | |
|---|---|---|---|
| 1,363,417 | 12/1920 | Hunt | 206/408 |
| 3,010,673 | 11/1961 | Marconi | 220/94 R |
| 3,771,487 | 11/1973 | McGee, Jr. | 242/85.1 |
| 4,026,063 | 5/1977 | Allen et al. | 206/408 |
| 4,033,276 | 7/1977 | Barr | 242/85.1 |
| 4,229,900 | 10/1980 | Collins | 242/96 |

FOREIGN PATENT DOCUMENTS

| | | | |
|---|---|---|---|
| 248311 | 12/1963 | Australia | 242/85.1 |
| 1082175 | 12/1954 | France | 242/84.2 J |

*Primary Examiner*—William T. Dixson, Jr.
*Assistant Examiner*—Brenda J. Ehrhardt
*Attorney, Agent, or Firm*—James E. Bradley

[57] ABSTRACT

A storage compartment has features that allow it to conveniently store water ski rope. The compartment has a base and a lid. A spool is rigidly secured to the base and extends outwardly from the base. The lid and the base are connected together by a hinge, with the lid enclosing the spool when the compartment is closed. The spool has on one side a recess for receiving water ski floats. On the bottom of the base, a depression extends inwardly into the spool. This depression has a flange that encircles and overlies part of the depression. The flange serves as a handle for the compartment.

5 Claims, 3 Drawing Figures

WATER SKI ROPE STORAGE COMPARTMENT

BACKGROUND OF THE INVENTION

This invention relates in general to spools for storing cord, and in particular to a compartment for use in storing water ski rope.

A water ski rope is a cord normally made of woven nylon and is about ½ inch in diameter. The rope is normally from 75 to 100 feet long. A hook is located on one end for connection to a ring secured with the boat. On the other end, one or more handles are secured to the rope. The handles either comprise a single plastic bar about one foot across or two separate plastic bars each about six inches across. Usually a plastic float is secured to the rope near the end with the handles.

Most boaters simply coil the water ski rope into a loose coil when it is not in use. Often, if the rope is temporarily not to be used, the boater will leave the hook attached to the boat ring. The loosely coiled rope often tangles and is an obstruction in the bottom of the boat. When playing out the line to begin water skiing, tangles are encountered. Also, when playing out the line to being water skiing, if one is not careful, too much rope will lie in the water near the boat and possibly become tangled in the propeller of the boat.

Storage reels and spools are available for winding the ski rope when not in use. The available reels are subject to a number of deficiencies. Some require mounting to the boat by screws or bolts, and this is undesirable to many boat owners. Most reels have no provision for securing the handle when the ski rope is wound up. Also, some of the reels require that the hook be unfastened from the boat ring. This is inconvenient if the rope is only temporarily being placed out of the way.

SUMMARY OF THE INVENTION

In this invention, a device is provided for storing cord, particularly water ski rope. The device is a compartment having a base and a lid that have peripheral walls that mate to define an enclosure. The walls are connected together by a hinge, and fasteners are provided to secure the base and lid together. A spool extends outwardly from the base for winding the ski rope. The spool has a flared lip to allow the rope to play out easily. The spool has a cavity in its center for storage of the floats. Retaining clips are located on the inside surface of the lid for retaining the handles.

The bottom surface of the base has a depression in it that extends upwardly into the spool. A flange extends over part of the depression, defining a clearance for a user to grasp the flange and place his fingers therein to hold the compartment. This provides a rigid handle with a surface flush with the bottom of the base. One of the peripheral walls of the base or lid has a slot through it to allow the rope to remain connected with the boat ring while wound about the spool.

DESCRIPTION OF THE PREFERRED EMBODIMENT

Figure 1:
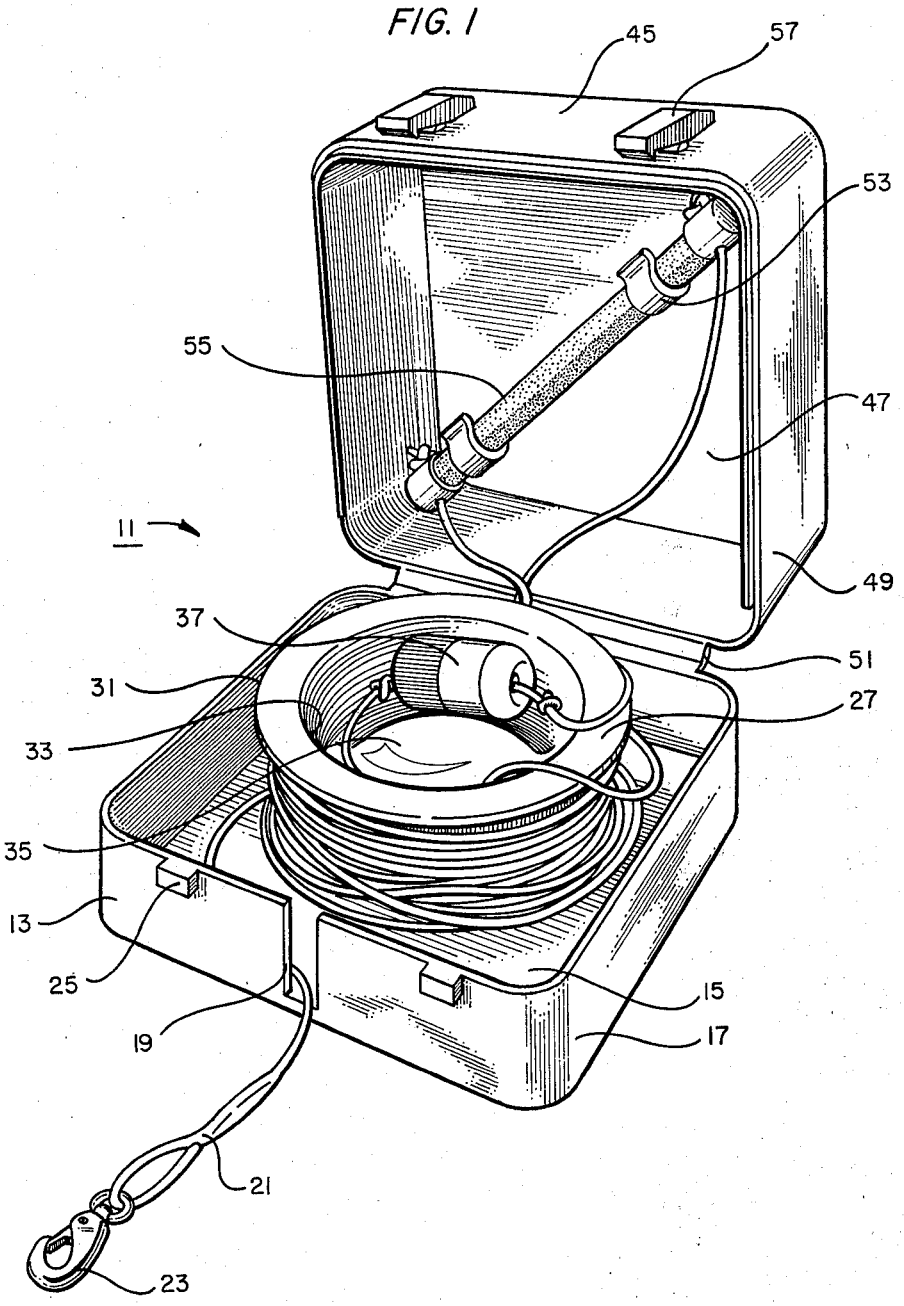
FIG. 1 is a perspective view showing a water ski storage compartment constructed in accordance with this invention.

Referring to FIG. 1, compartment 11 includes a base 13. Base 13 has a flat bottom 15 and peripheral walls 17. Walls 17 extend outwardly from bottom 15 at a 90 degree angle. Walls 17 define a generally rectangular container with rounded corners.

The forward wall 17 has a slot or aperture 19 extending through it. Aperture 19 extends from the upper edge of wall 17 to the bottom 15. Aperture 19 allows a ski rope 21 to extend from compartment 11 when compartment 11 is closed. A hook 23 is located on the extreme end of ski rope 21 for connection to an eyelet or ring (not shown) of a boat. The forward wall 17 also has two spaced-apart tabs 25 for fastening the compartment.

A spool 27 extends upwardly from the bottom 15 of base 13. As shown also in FIG. 3, spool 27 is formed integrally with bottom 15, thus is not rotatable with respect to base 13. Spool 27 is generally cylindrical, having an annular periphery 29 (FIG. 3), about which ski rope 21 is wound. Periphery 29 is curved in cross-section and terminates on the free end in a flared lip 31. The curved configuration of periphery 29 provides an outward inclination to lip 31 to facilitate playing out of rope 21. The distance from bottom 15 to lip 31 is about twice the distance from bottom 15 to the upper edges of walls 17. The diameter of spool 27 at the bottom 15 is about the same as at lip 31, this diameter being slightly greater than half the width of bottom 15.

A recess or cavity 33 is formed in the outer side of spool 27. Recess 33 has a concave partition on bottom 35. Recess 33 extends almost the full width or diameter of spool 27 and serves to receive one or more floats 37 (FIG. 1).

Figure 3:
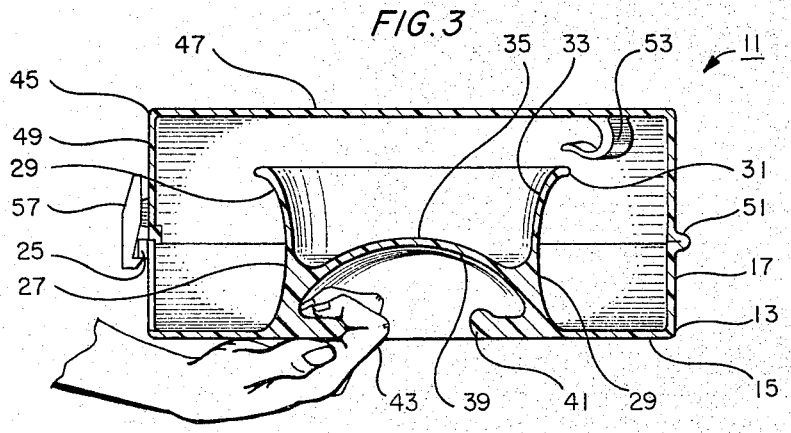
FIG. 3 is a sectional view of the compartment of FIG. 1, taken along the line III—III of FIG. 2.

The lower surface of the base bottom 15 has a depression 39 formed in it. Depression 39 is a circular concave depression bounded by and separated from recess 33 by the recess bottom 35. Recess 33 and depression 39 are co-axial with the axis of spool 27, which is centered in the bottom 15 of base 13. A flange 41 is formed integrally with base bottom 15 and extends around the periphery of depression 39. As shown in FIG. 3, flange 41 extends inwardly a short distance and overlies the depression 39, defining a clearance. The upper surface of flange 41 is contoured to comfortably receive the fingers 43 of a user. Flange 41 enables the user to hold the compartment 11, serving as a handle means. The lower surface of flange 41 is flat and co-planar with bottom 15.

Referring again to FIG. 1, compartment 11 has a lid 45. Lid 45 has a flat top 47 and walls 49 extending around the periphery. Walls 49 define a generally rectangular container, similar to base walls 17. Walls 49 also are located at right angles with respect to the top 47. The rearward wall 49 is connected by a hinge 51 to the rearward base wall 17.

Figure 2:
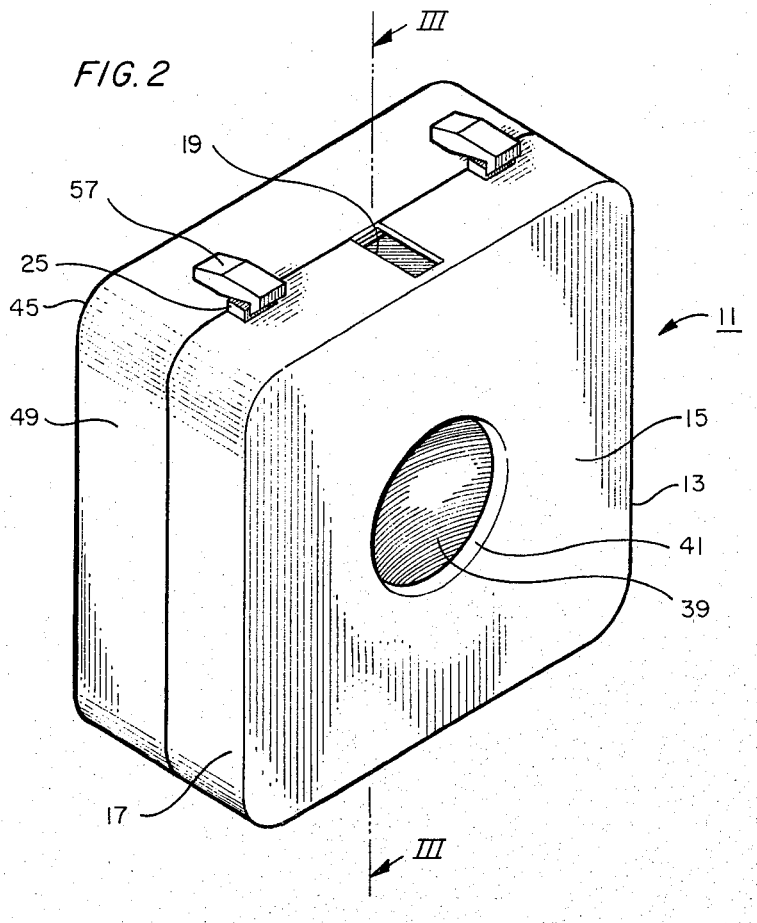
FIG. 2 is another perspective view of the compartment of FIG. 1, shown in the closed position.

A pair of brackets or clips 53 are located on the inside surface of the top 47. Clips 53 are spaced apart to receive a ski rope handle 55. Preferably, the clips 53 are spaced so as to place the handle 55 diagonally with respect to the compartment walls 17 and 49. Clips 53 are resilient, opposed, hook shaped members. Lid 49 further has a pair of snap fasteners 57 on its forward wall that are positioned to engage tabs 25 on the base wall 17. Clips 57 and tabs 25 serve as closure means for closing the compartment 11. In the closed position, as shown in FIG. 2, the walls 17 of base 13 will abut with the walls 49 of lid 45.

In operation, a rope 21 is manually wound around spool 27 while the user has the compartment 11 in the open position and is holding the compartment 11 by means of the flange 41. When fully wound, handle 55 will be placed within and retained by clips 53. Normally, hook 23 will be located inside the base 13. One or more floats 37 will be located inside recess 33. Fasteners 57 will secure the compartment in the closed position.

When it is desired to use the rope, handle 55 will be detached from clips 53 and a selected amount of rope 21 will be unwound. Handle 55 will be thrown in the water and hook 23 will normally be attached to a ring of the boat. As the boat begins to move away from the water skier and the handle 55, the person playing out the rope 21 will hold the compartment with his fingers 43 as shown in FIG. 3.

To allow the line to play out freely, he will hold the compartment base 13 in a generally vertical orientation, with the axis of spool 27 generally parallel with the rope being played out. The friction of the rope 21 in the water will draw more rope off over the lip 31, playing out the rope in an orderly manner as the boat moves away. To slow the playing out of rope, the user turns the compartment sideways so that the spool 27 axis is more of an angle with respect to the rope already played out. In a position with the spool axis perpendicular to the rope, the rope 21 will not slip over lip 31, and rope will not play out. When all of the rope is played out, compartment 11 may be closed and placed out of the way in the boat, completely separate from the rope 21.

If it is desired to wind in the rope only for a short while, it may be desirable to leave the hook 23 connected to the ring of the boat. In such a case, the user simply pulls the rope 21 in and winds it about spool 27. When fully wound, he places the handle 55 in the clips 53. The end of rope 21 leading to hook 23 will be placed through aperture 19. This allows the compartment 11 to be closed and placed to one side, while the hook 23 is still connected to the boat. The rope can subsequently be played out again as discussed above.

The invention has significant advantages. The compartment provides a compact, convenient place to store a ski rope, including its hook, handle and float. This avoids tangling and obstructions caused by loose ropes. When it is desired to play out the rope, the rope is orderly played out by allowing it to be pulled over the flared lip of the spool. The slotted wall allows the rope to be temporarily rewound about the spool while the hook remains connected to the boat.

The recessed handle allows the compartment to be rigidly gripped when playing out the line so that the user can move it between horizontal and vertical positions to control the rate at which the rope is played out. The recessed handle also provides a flat bottom surface for storage and stacking.

While the invention has been shown in only one of its forms, it should be apparent to those skilled in the art that it is not so limited but is susceptible to various changes without departing from the scope of the invention.

I claim:

1. A device for storing cord, comprising:

a compartment having a base and a lid connected together by a hinge; and a spool extending rigidly upward from the inside surface of the base and having an annular periphery for winding cord;

the spool having on its side opposite the base an outwardly inclined circular lip of diameter less than the width of the base; and wherein the base has a bottom and the lid has a top, the bottom and the top having depending walls that mate to enclose the spool, one of the walls having an aperture for allowing cord to extend through when the compartment is closed.

2. A compartment for storing cord, comprising:

a base with a flat bottom and a peripheral wall;

a lid having a flat top and a peripheral wall that is connected by a hinge to the wall of the base;

one of the walls having an aperture therethrough for a cord to extend through when the base and lid are closed together; and a spool extending rigidly upward from the bottom of the base past the edge of the wall of the base, the spool having an annular periphery for winding cord, the spool having on its side opposite the base a flared lip of diameter less than the width of the base, the spool having a recess that extends inwardly from the lip and has a bottom;

the bottom of the base having a depression formed therein that extends into the spool and is separated from the recess by the bottom of the recess;

the base having a flange that extends over part of the depression, defining a clearance for receiving a user's fingers.

3. The compartment according to claim 2 wherein the flange extends continuously around the periphery of the depression.

4. The compartment according to claim 2 wherein the compartment further has clip means on the inside surface of the lid for retaining a water ski rope handle.

5. The compartment according to claim 2 wherein the flange has an outer surface that is flat and flush with the bottom of the base.

* * * * *